US011164536B2

(12) United States Patent
Chen et al.

(10) Patent No.: US 11,164,536 B2
(45) Date of Patent: Nov. 2, 2021

(54) GATE ON ARRAY CIRCUIT AND DISPLAY DEVICE

(71) Applicant: NOVATEK MICROELECTRONICS CORP., HsinChu (TW)

(72) Inventors: Hung-Hsiang Chen, Hsinchu (TW); Tso-Hua Chien, Hsinchu (TW); Huang-Chin Tang, Zhubei (TW)

(73) Assignee: NOVATEK MICROELECTRONICS CORP., Hsinchu (TW)

( * ) Notice: Subject to any disclaimer, the term of this patent is extended or adjusted under 35 U.S.C. 154(b) by 0 days.

(21) Appl. No.: 16/869,658

(22) Filed: May 8, 2020

(65) Prior Publication Data

US 2020/0327858 A1 Oct. 15, 2020

Related U.S. Application Data

(63) Continuation-in-part of application No. 16/748,832, filed on Jan. 22, 2020, and a continuation-in-part of application No. 16/748,781, filed on Jan. 21, 2020.

(60) Provisional application No. 62/845,903, filed on May 10, 2019, provisional application No. 62/896,592, filed on Sep. 6, 2019, provisional application No. 62/799,724, filed on Jan. 31, 2019.

(51) Int. Cl.
*G09G 3/36* (2006.01)

(52) U.S. Cl.
CPC ... *G09G 3/3677* (2013.01); *G09G 2300/0408* (2013.01); *G09G 2310/0202* (2013.01); *G09G 2310/08* (2013.01)

(58) Field of Classification Search
CPC ... G09G 2300/0408; G09G 2310/0202; G09G 2310/0213; G09G 2310/0216; G09G 2310/08; G09G 2320/0219; G09G 2320/0233; G09G 2320/0242; G09G 3/2003; G09G 3/3614; G09G 3/3677
See application file for complete search history.

(56) References Cited

U.S. PATENT DOCUMENTS

| | | | | |
|---|---|---|---|---|
| 7,868,861 | B2 * | 1/2011 | Cho | G09G 3/3648 345/87 |
| 2010/0110359 | A1 * | 5/2010 | Lee | G09G 3/3614 349/149 |
| 2010/0156947 | A1 * | 6/2010 | Moon | G09G 3/3648 345/690 |
| 2012/0120034 | A1 * | 5/2012 | Lee | G09G 3/3677 345/205 |
| 2017/0123581 | A1 * | 5/2017 | Yang | G06F 3/0446 |

* cited by examiner

*Primary Examiner* — Hong Zhou
(74) *Attorney, Agent, or Firm* — McClure, Qualey & Rodack, LLP

(57) ABSTRACT

A gate on array circuit for a display device using dual-gate architecture is disclosed. The GOA circuit comprises circuitry configured to, for a first display line of the display device, generate a first gate driving signal and a second gate driving signal for driving a first gate line and a second gate line of the first display line respectively. A first time period when the first gate driving signal is in an activation state for activating the first gate line of the first display line does not overlap with a first time period when the second gate driving signal is in the activation state for activating the second gate line of the first display line.

20 Claims, 13 Drawing Sheets

GATE ON ARRAY CIRCUIT AND DISPLAY DEVICE

This application claims the benefit of U.S. provisional application Ser. No. 62/845,903, filed May 10, 2019. This application is a continuation-in-part of U.S. patent application Ser. No. 16/748,832 filed Jan. 22, 2020, which is a continuation-in-part of U.S. patent application Ser. No. 16/748,781, filed Jan. 21, 2020, now U.S. Pat. No. 10,984,697. U.S. patent application Ser. No. 16/748,832 claims the benefit of U.S. provisional application Ser. No. 62/896,592 filed Sep. 6, 2019. U.S. patent application Ser. No. 16/748,781 claims the benefit of U.S. provisional application Ser. No. 62/799,724, filed Jan. 31, 2019. The subject matters of which are incorporated herein by reference.

BACKGROUND OF THE INVENTION

Field of the Invention

The invention relates to a gate on array circuit and a display device.

Description of the Related Art

Dual-gate architecture is widely applied on display devices of medium and large size, since the dual gate architecture may allow the source channels of the driver IC of the display device to be halved to achieve cost reduction. In recent years, in order to increase the screen-to-body ratio of mobile phones, the dual-gate architecture is gradually being applied to small-sized display devices, since the size of the border of mobile phones may be reduced. However, in the dual-gate architecture, the number of gate lines may increase by a factor of two. Since the distance between adjacent gate lines becomes smaller, the influence of the parasitic capacitance becomes greater, and a number of vertical lines of non-uniform luminance are generated.

SUMMARY OF THE INVENTION

An embodiment of the present invention discloses a gate on array (GOA) circuit for a display device using dual-gate architecture. The GOA circuit comprises circuitry, configured to, for a first display line of the display device, generate a first gate driving signal and a second gate driving signal for driving a first gate line and a second gate line of the first display line respectively. A first time period when the first gate driving signal is in an activation state for activating the first gate line of the first display line does not overlap with a second time period when the second gate driving signal is in the activation state for activating the second gate line of the first display line.

Another embodiment of the present invention discloses a display device using dual-gate architecture. The display device comprises a plurality of display lines and a gate on array (GOA) circuit. Each of the display lines comprises a plurality of sub-pixels, a first gate line and a second gate line. The GOA circuit is coupled to the display lines, and configured to, for a first display line of the display lines, generate a first gate driving signal and a second gate driving signal for driving a first gate line and a second gate line of the first display line respectively. A first time period when the first gate driving signal is in an activation state for activating the first gate line of the first display line does not overlap with a second time period when the second gate driving signal is in the activation state for activating the second gate line of the first display line.

Yet another embodiment of the present invention discloses a gate driving control circuit for a display device using dual-gate architecture. The display device comprises a GOA circuit and a display panel comprising a plurality of display lines. Each of the display lines comprising a plurality of sub-pixels, a first gate line and a second gate line, The gate driving control circuit comprises circuitry, configured to, generating a plurality of control signals for controlling the GOA circuit to generate a plurality of gate driving signals for scanning the plurality of gate lines of the display panel. The GOA circuit is controlled to, for a first display line of the display device, generate a first gate driving signal and a second gate driving signal for driving a first gate line and a second gate line of the first display line respectively. A timing of the first gate driving signal and a timing of the second gate driving signal are set to reduce coupling effect between the first gate line and the second gate line of the display line.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1:
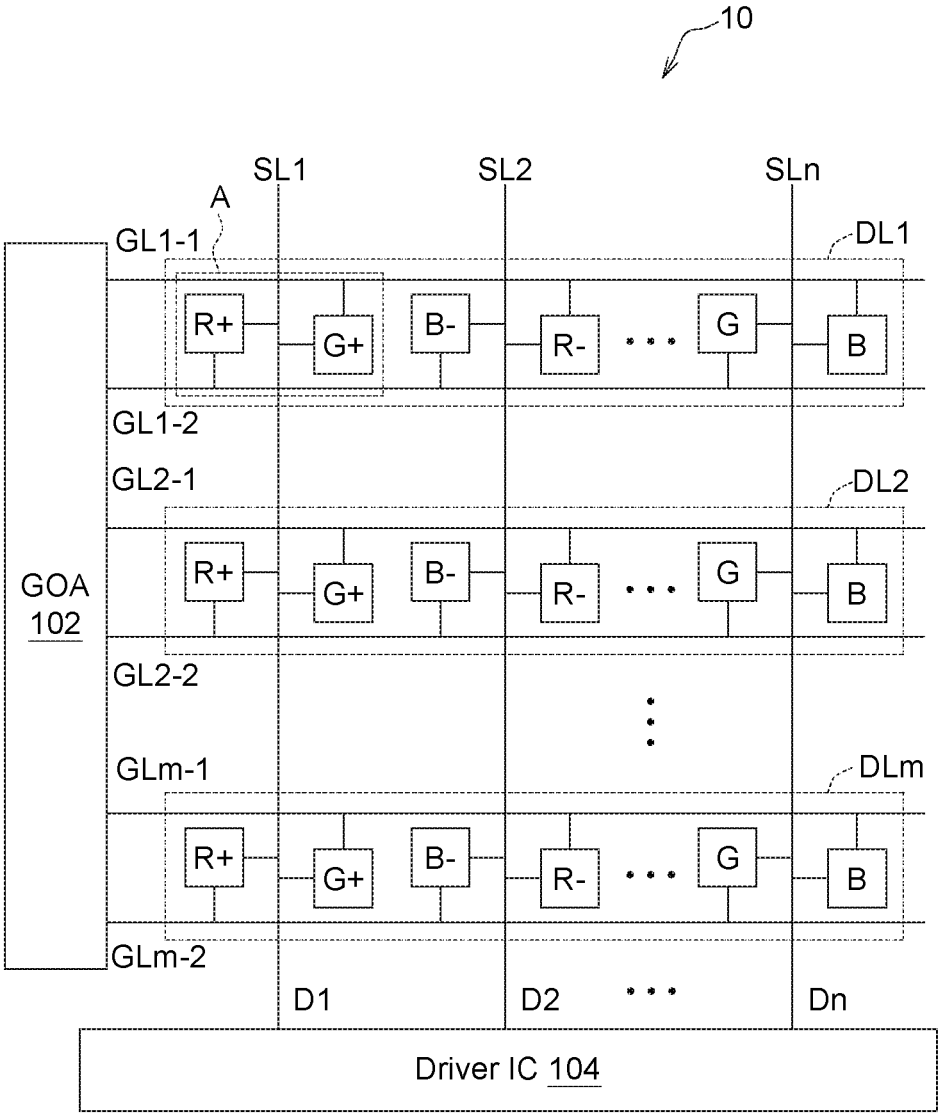
FIG. 1 shows a block diagram of a display device according to an embodiment of the present invention.

Referring to FIG. 1, FIG. 1 shows a block diagram of a display device according to an embodiment of the present invention. The display device 10 includes a display panel which may include a number of display lines DL1~DLm and a number of source lines SL1~SLn. In addition, the display device 10 can further include a gate on array (GOA) circuit 102, which may be disposed on the display panel. Furthermore, the display device 10 can include a driver integrated circuit (IC) 104. In some implementations, the GOA circuit 102 can be separated from the driver integrated circuit 104. In some implementations, the GOA circuit 102 can be integrated with the driver integrated circuit 104. Each of the display lines DL1~DLm includes a first gate line GL1-1~GLm-1, a second gate line GL1-2~GLm-2 and a number of sub-pixels R, G, B. For each of the display lines DL1~DLm, half of the sub-pixels are coupled to the first gate lines, the other half of the sub-pixels are coupled to the second gate line. The GOA circuit 102 can be coupled to the gate lines GL1-1, GL1-2~GLm-1, GLm-2. Each of the source lines SL1~SLn can be coupled to two columns of sub-pixels. The driver IC 104 can be coupled to the source lines SL1~SLn via two data lines D1~Dn respectively. The driver IC 104 is configured to output pixel data via the data lines D1~Dn. In addition, the display device 10 further includes a gate driving control circuit (not shown), coupled to the GOA circuit 102. The gate driving control circuit is configured to generate a number of control signals for controlling the operation of the GOA circuit 102. For example, the gate driving control circuit may control the GOA circuit 102 to generate a number of gate driving signals for scanning the plurality of gate lines of the display pane. In an embodiment, the gate driving control circuit may be integrated in the driver IC 104. In another embodiment, the gate driving control circuit may be an independent circuit from the driver IC 104 and the GOA circuit 102.

Figure 2:
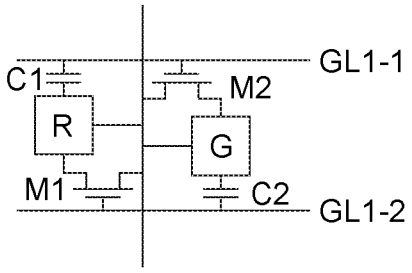
FIG. 2 shows an equivalent circuit of two sub-pixels of the display line DL1.
Figure 3:
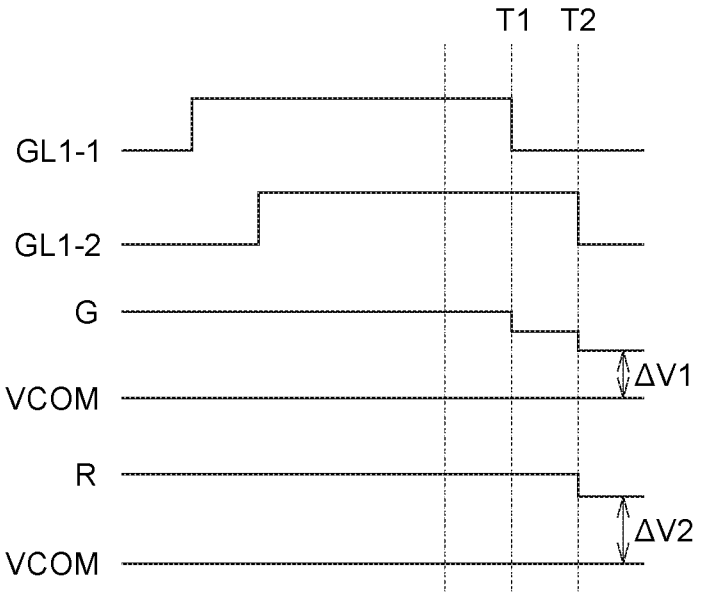
FIG. 3 shows a schematic diagram that shows the voltage variation of the sub-pixels R, G under the influence of parasitic capacitances C1, C2 in the case of gate driving signals generated by a conventional GOA circuit.

Referring to FIG. 2, FIG. 2 shows an equivalent circuit of two sub-pixels of the same display line, e.g., the display line DL1 in an example. As shown in FIG. 2, a first sub-pixel, e.g., the sub-pixel R can be coupled to the gate line GL1-2 and the source line SL1 via a transistor M1, and a second sub-pixel, e.g., the sub-pixel G can be coupled to the gate line GL1-1 and the source line SL1 via a transistor M2. In a real case, there is a parasitic capacitance C1 between the sub-pixel R and the gate line GL1-1, and there is a parasitic capacitance C2 between the sub-pixel G and the gate line GL1-2, Due to the parasitic capacitance C1 the change of the signal voltage on the gate line GL1-1 may affect the pixel data already written in the sub-pixel R. Similarly, due to the parasitic capacitance C2, the change of the signal voltage on the gate line GL1-2 can affect the pixel data already written in the sub-pixel G. Consequently, the luminance of the sub-pixel R and the sub-pixel G may be different, FIG. 3 shows a schematic diagram that shows the voltage variation of the sub-pixels R, G under the influence of parasitic capacitances C1, C2 for the example shown in FIG. 2. At a first time T1, the witting of pixel data for the sub-pixel G is completed, but the voltage of the pixel data stored in the sub-pixel G is coupled downward due to the high-to-low transition of the gate driving signal on the gate line GL1-1. At a second time T2, the witting of pixel data for the sub-pixel R is completed, but the voltage of the pixel data stored in the sub-pixel R is coupled downward due to the high-to-low transition of the gate driving signal on the gate line GL1-2. Simultaneously, the voltage of the pixel data stored in the sub-pixel G is coupled downward again due to the high-to-low transition of the gate driving signal on the gate line GL1-2, by the parasitic capacitance C2. This may cause the voltage difference ΔV1 between the voltage of the pixel data stored in the sub-pixel G and a VCOM voltage to be different from the voltage difference ΔV2 between the voltage of the pixel data stored in the sub-pixel R and the VCOM voltage. ΔV1 different from ΔV2 may cause the luminance of the sub-pixel G to be different from the luminance of the sub-pixel R. This may cause the screen displayed by the display device to produce a visual experience of non-uniform brightness. On the giant view, this may cause the screen displayed by the display device to produce a visual experience of non-uniform luminance.

Figure 4A:
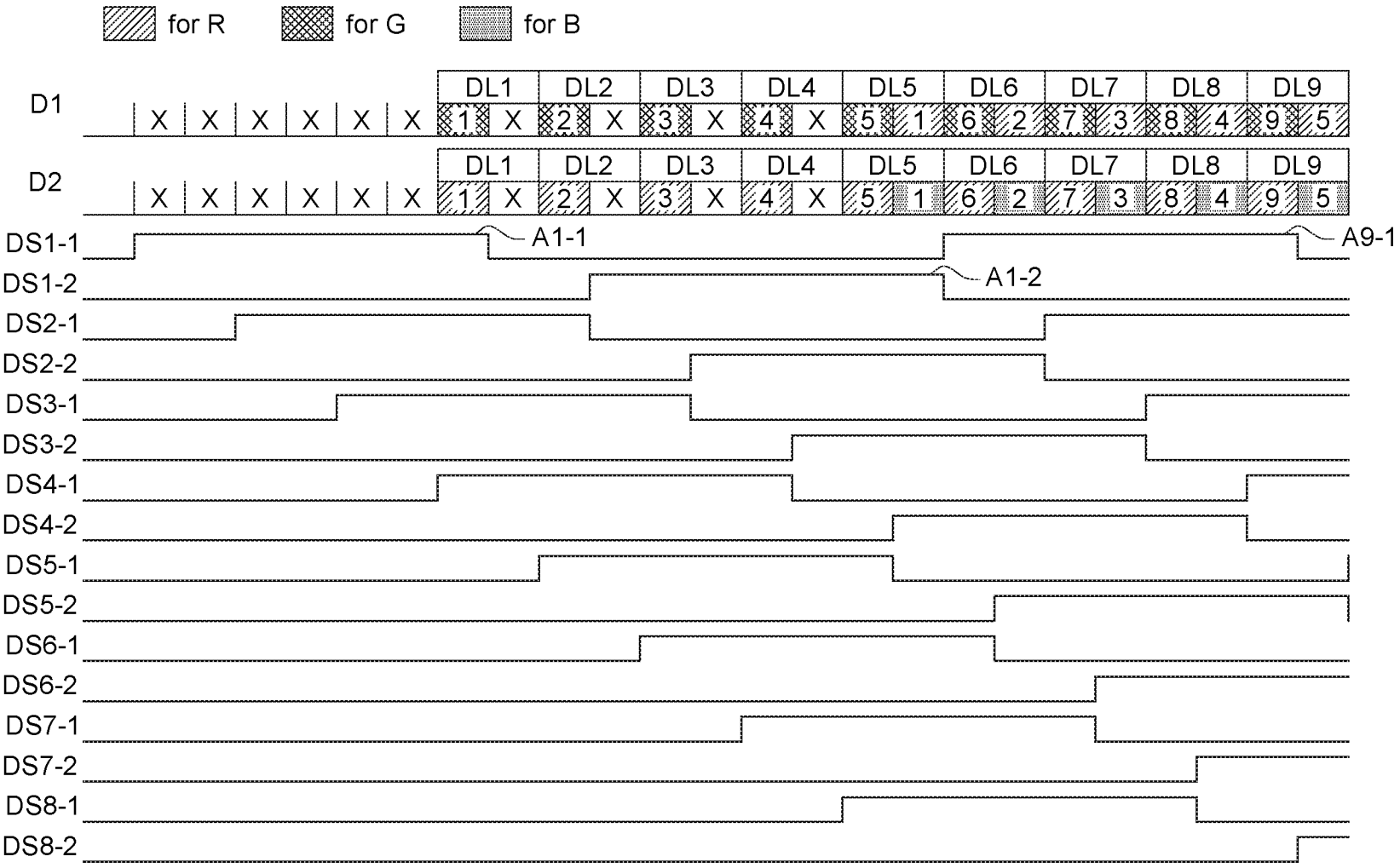
FIG. 4A shows a timing diagram of gate driving signals according to an embodiment of the present invention.
Figure 4B:
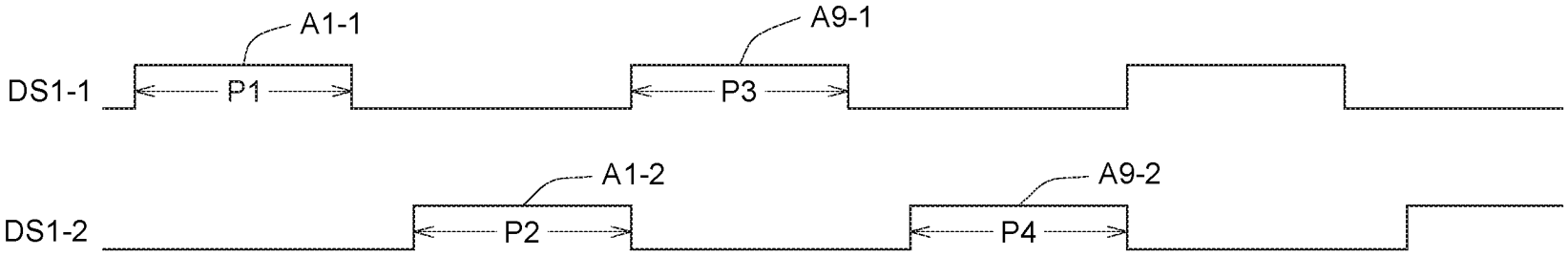
FIG. 4B shows a timing diagram of the first gate driving signal and the second gate driving signal according to an embodiment of the present invention.

To solve the above problem, according to an embodiment of the present invention, the GOA circuit 102 of the display device 10, which can be controlled by the gate driving control circuit (not shown), includes circuitry which is configured to generate a number of gate driving signals as shown in FIG. 4A. That is, for the display lines DL1~DLm, the GOA circuit 102 is configured to generate a plurality of gate driving signals DS1-1~DS8-2. Each of the gate driving signals DS1-1~DS8-2 may be used for driving one or more gate lines by a time division manner. For example, the gate driving signals DS1-1~DS8-2 are transmitted to the gate lines GL1-1~GL8-2 respectively. The gate driving signals DS1-1~DS8-2 may also be transmitted to other gate lines which are not shown in the figure. The gate driving signal DS1-1 may be used for driving the gate line GL1-1 and the gate line GL9-1 (not shown) in different time periods. An activation state A1-1 of a first gate driving signal DS1-1 may be transmitted to the first gate line GL1-1 of the display line DL1 for activating the first gate line GL1-1 of the display line DL1. Another activation state A9-1 of the first gate driving signal DS1-1 may be transmitted to the first gate line GL9-1 of the display line DL9 for activating the first gate line GL9-1 of the display line DL9. An activation state A1-2 of a second gate driving signal DS1-2 may be transmitted to the second gate line GL1-2 of the display line DL1 for activating the second gate line GL1-2 of the display line DL1. In addition, the second driving signal DS1-2 may include another activation state A9-2 to be transmitted to the second gate line GL9-2 of the display line DL9 for activating the second gate line GL9-2 of the display line DL9. A first time period P1 when the first gate driving signal DS1-1 is in the activation state A1-1 for activating the first gate line GL1-1 of the display line DL1 does not overlap with a second time period P2 when the second gate driving signal DS1-2 is in the activation state A1-2 for activating the second gate line GL1-2 of the display line DL1. Furthermore, although it is not shown in FIG. 4A, it is shown in FIG. 4B that a third time period P3 when the first gate driving signal DS1-1 is in the activation state A9-1 for activating the first gate line GL9-1 of the display line DL9 does not overlap with a fourth time period P4 when the second gate driving signal DS1-2 is in the activation state for activating the second gate line GL9-2 of the display line DL9.

In this embodiment, the third time period P3 when the first gate driving signal DS1-1 is in the activation state A9-1 for activating the first gate line GL9-1 of the display line DL9 does not overlap with the second time period P2 when the second gate driving signal DS1-2 is in the activation state A1-2 for activating the second gate line GL1-2 of the display line DL1. That is, the first gate driving signal may have a plurality of time periods when the first gate driving signal is in the activation state and the second gate driving signal may have a plurality of time periods when the first gate driving signal is in the activation state, and none of the time periods when the second gate driving signal is in the activation state overlaps with any of the time periods when the first gate driving signal is in the activation state. That is, there is none of the activation states of the first gate driving signal DS1-1 overlaps with the activation states of the second gate driving signal DS1-2.

In this embodiment, the activation state is logical high, and a non-activation state is logical low.

For each of the data lines D1~Dn, the driver IC 104 is configured to output pixel data corresponding to the gate lines which are activated by using a time division manner.

Figure 5:
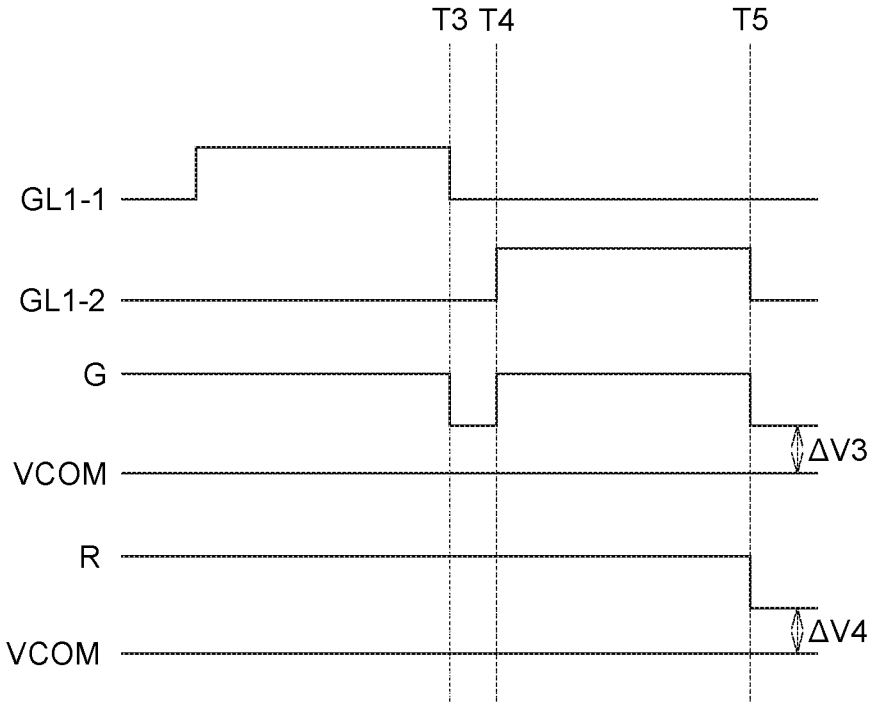
FIG. 5 shows a schematic diagram that shows the voltage variation of the sub-pixels R, G under the influence of parasitic capacitances C1, C2 in the case of gate driving signals generated by a GOA circuit according to an embodiment of the present invention.

FIG. 5 shows a schematic diagram that shows the voltage variation of the sub-pixels R, G under the influence of parasitic capacitances C1, C2 in the case of gate driving signals generated by the GOA circuit according to an embodiment of the present invention. FIG. 5 shows a case where the gate line GL1-1 is charged first and the gate line GL1-2 is charged later. At T3, the writing of pixel data for the sub-pixel G is completed, but the voltage of the pixel data stored in the sub-pixel G is coupled downward due to the high-to-low transition of the first gate driving signal on the gate line GL1-1. At T5, the writing of pixel data for the sub-pixel R is completed, but the voltage of the pixel data stored in the sub-pixel R is coupled downward due to the high-to-low transition of the second gate driving signal on the gate line GL1-2. Simultaneously, the voltage of the pixel data stored in the sub-pixel G is coupled downward again due to the high-to-low transition of the second gate driving signal on the gate line GL1-2, by the parasitic capacitance C2. However, since the voltage of the pixel data stored in the sub-pixel G is coupled upward due to the low-to-high transition of the second gate driving signal on the gate line GL1-2 by the parasitic capacitance C2 at T4, the influence of the parasitic capacitance C2 at T5 can be offset. Therefore, the voltage difference ΔV3 between the voltage of the pixel data stored in the sub-pixel G and a VCOM voltage may equal to the voltage difference ΔV4 between the voltage of the pixel data stored in the sub-pixel R and the VCOM voltage. It is noted that the case shown in FIG. 5 can be easily analogized to an opposite case where the gate line GL1-2 is charged first and the gate line GL1-1 is charged later.

Figure 6:
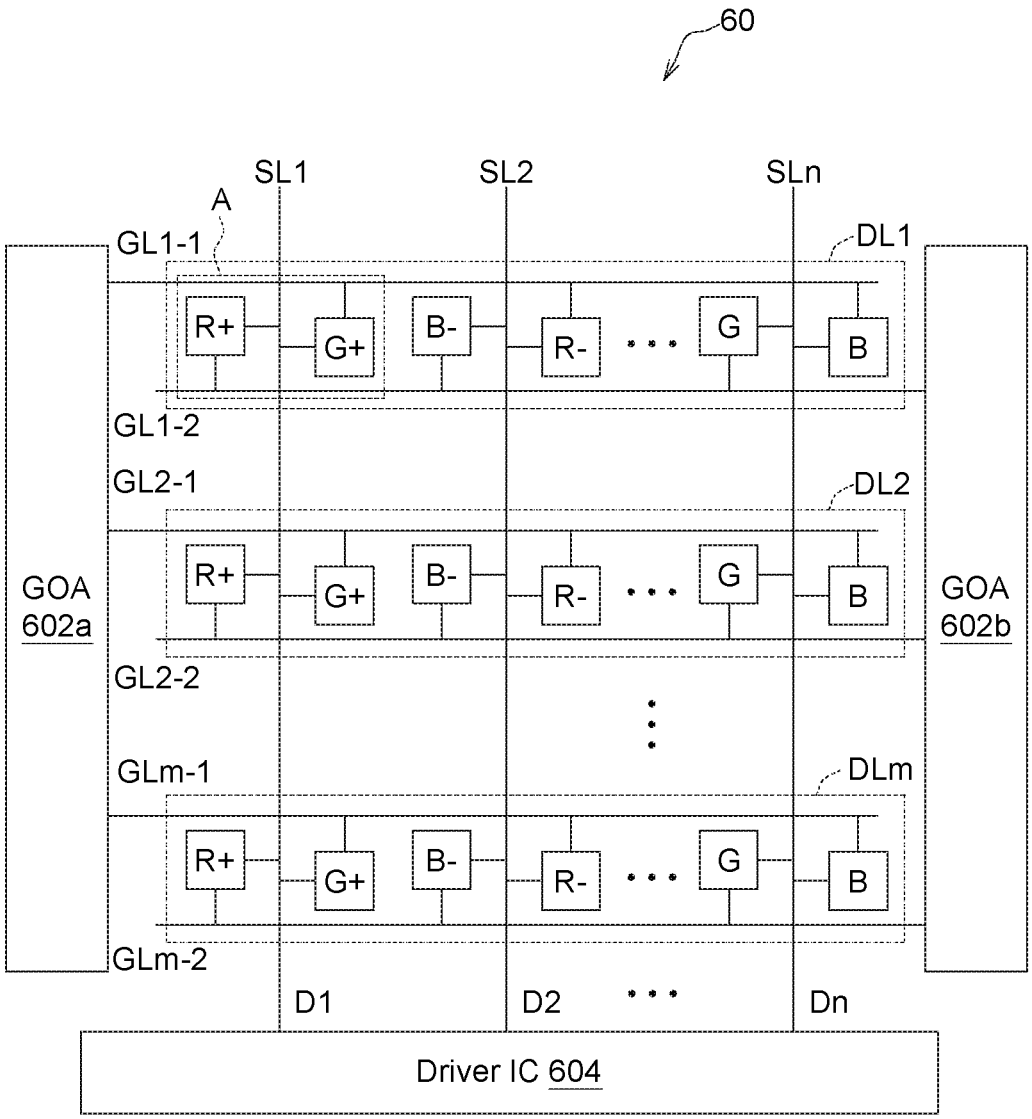
FIG. 6 shows a block diagram of a display device according to another embodiment of the present invention.
Figure 7A:
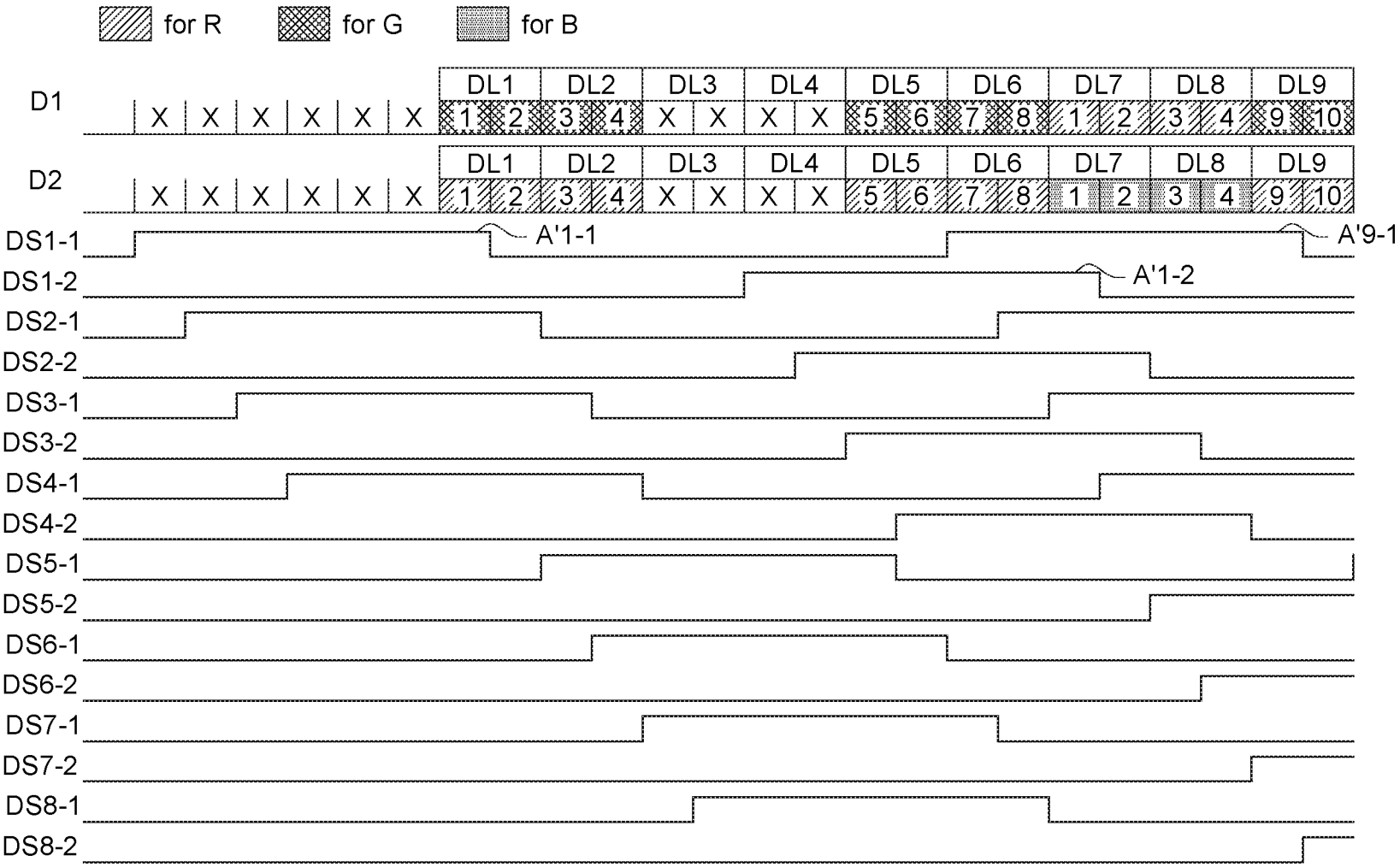
FIG. 7A shows a timing diagram of gate driving signals according to another embodiment of the present invention.
Figure 7B:
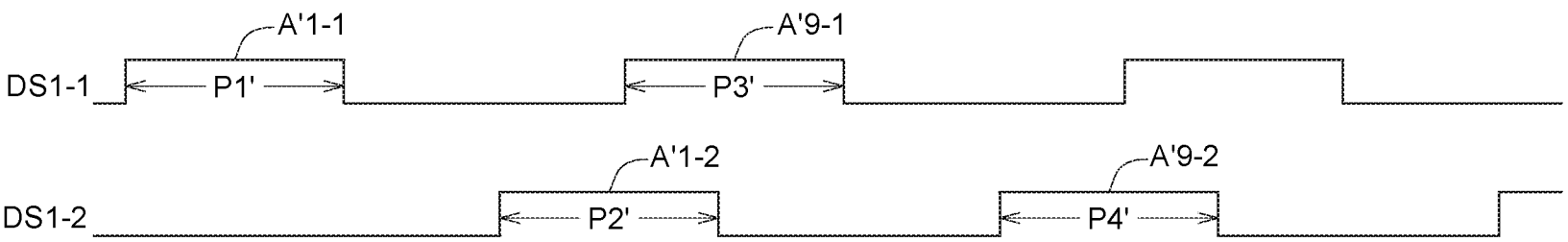
FIG. 7B shows a timing diagram of the first gate driving signal and the second gate driving signal according to another embodiment of the present invention.

Referring to FIGS. 6, 7A and 7B, FIG. 6 shows a block diagram of a display device according to another embodiment of the present invention, FIG. 7A shows a timing diagram of the gate driving signal generated by the first GOA circuit and the second GOA circuit in FIG. 6, and FIG. 7B shows a timing diagram of the first gate driving signal and the second gate driving signal generated by the first GOA circuit and the second GOA circuit in FIG. 6. The display device 60 is similar to the display device 10, the differences are that the display device 60 includes a first GOA circuit 602*a* and a second GOA circuit 602*b*, and that for each of the display lines DL1~DLm, one of the gate lines GL1-1~GLm-1 is coupled to the first GOA circuit 602*a*, and the other one of the gate lines GL1-2~GLm-2 is coupled to the second GOA circuit 602*b*. For each of the display lines DL1~DLm, the first GOA circuit 602*a* is configured to generate a first gate driving signal DS1-1, DS2-1, . . . , DS8-1, and the second GOA circuit 602*b* is configured to generate a second gate driving signal DS1-2, DS2-2, . . . , DS8-2. The first gate driving signals DS1-1~DS8-1 are transmitted to the first gate lines GL1-1, GL2-1, . . . , GL8-1 respectively, and the second gate driving signals DS1-2~DS8-2 are transmitted to the second gate lines GL1-2, GL2-2, . . . , GL8-2 respectively. Each of the first gate driving signals DS1-1~DS8-1 and the second gate driving signals DS1-2~DS8-2 may be used for driving one or more gate lines by a time division manner. For example, the first driving signal DS1-1 may be used for driving the gate line GL1-1 and the gate line GL9-1 in different time periods. An activation state A'1-1 of the first gate driving signal DS1-1 may be transmitted to the first gate line GL1-1 of the display line DL1 for activating the first gate line GL1-1 of the display line DL1. Another activation state A'9-1 of the first gate driving signal DS1-1 may be transmitted to the first gate line GL9-1 of the display line DL9 for activating the first gate line GL9-1 of the display line DL9. An activation state A'1-2 of the second gate driving signal DS1-2 may be transmitted to the second gate line GL1-2 of the display line DL1 for activating the second gate line GL1-2 of the display line DL1. A first time period P1' when the first gate driving signal DS1-1 is in the activation state A'1-1 for activating the first gate line GL1-1 of the display line DL1 does not overlap with a second time period P2' when the second gate driving signal DS1-2 is in the activation state A'1-2 for activating the second gate line GL1-2 of the display line DL1.

In this embodiment, a third time period P3' when the first gate driving signal DS1-1 is in the activation state A'9-1 for activating the first gate line GL9-1 of the display line DL9 partially overlaps with the second time period P2' when the second gate driving signal DS1-2 is in the activation state A'1-2 for activating the second gate line GL1-2 of the display line DL1. That is, the first gate driving signal has a plurality of time periods when the first gate driving signal is in the activation state and the second gate driving signal has a plurality of time periods when the first gate driving signal is in the activation state, and at least one of the time periods when the second gate driving signal is in the activation state overlaps with at least one of the time periods when the first gate driving signal is in the activation state. However, the first gate line activated by the activation state (e.g., A'9-1) of the first gate driving signal which overlaps with the activation state (e.g., A'1-2) of the second gate driving signal belongs to a different display line (e.g., DL9) from the display line (e.g., DL1) which is activated by the activation state (e.g., A'1-2) of the second gate driving signal.

Figure 8:
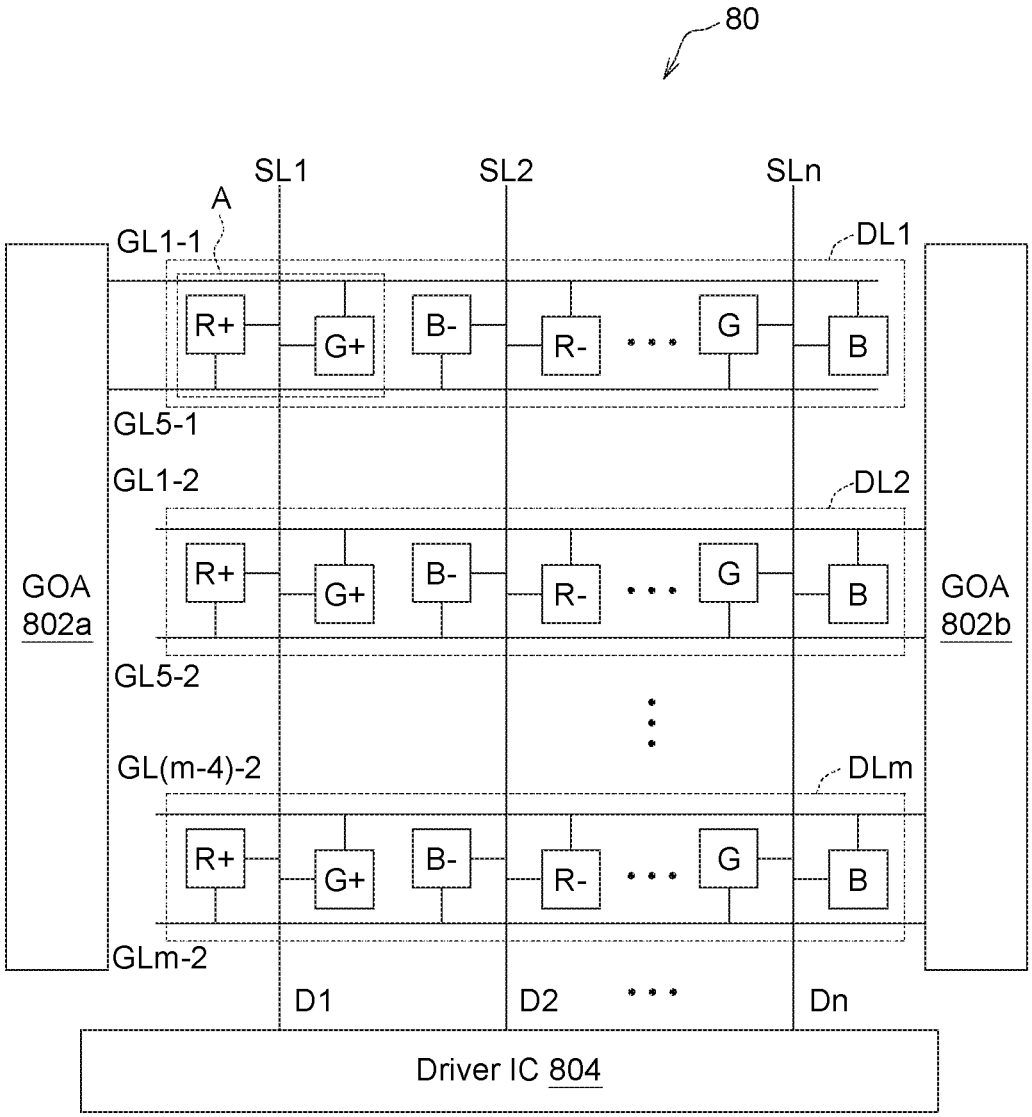
FIG. 8 shows a block diagram of a display device according to yet another embodiment of the present invention.
Figure 9A:
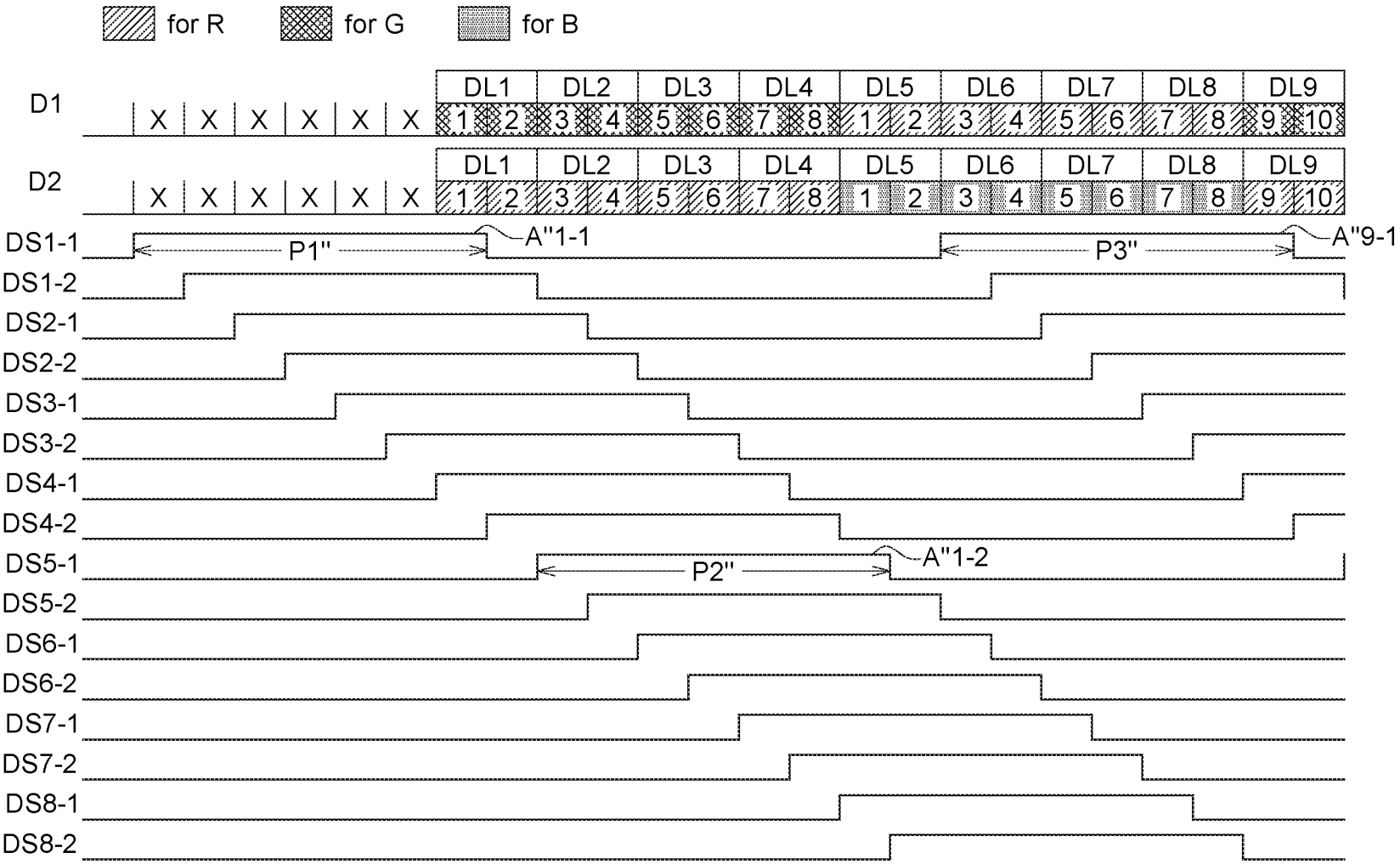
FIG. 9A shows a timing diagram of gate driving signals according to another embodiment of the present invention.
Figure 9B:
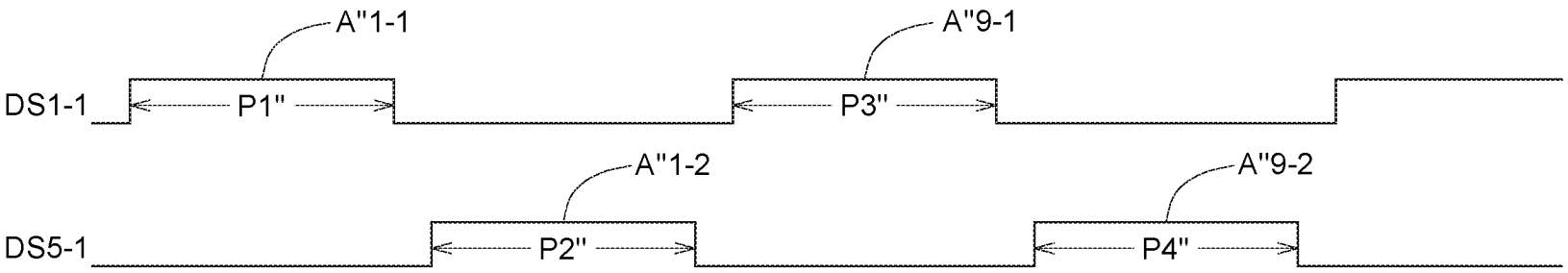
FIG. 9B shows a timing diagram of the first gate driving signal and the second gate driving signal according to yet another embodiment of the present invention.

Referring to FIGS. 8, 9A and 9B, FIG. 8 shows a block diagram of a display device according to yet another embodiment of the present invention, FIG. 9A shows a timing diagram of the gate driving signal generated by the first GOA circuit and the second GOA circuit in FIG. 8, and FIG. 9B shows a timing diagram of the first gate driving signal and the second gate driving signal generated by the first GOA circuit and the second GOA circuit in FIG. 8. The display device 80 is similar to the display device 60, the differences are that portion of the display lines are coupled to the first GOA circuit 802*a*, and the other display lines are coupled to the second GOA circuit 802*b*. The timing diagram of the gate driving signals is shown in FIG. 9A. It should be noted that the gate driving signals for the display line DL1 are gate driving signal DS1-1 and the gate driving signal DS5-1, the gate driving signals for the display line DL2 are gate driving signal DS1-2 and the gate driving signal DS5-2, and so on. The activation state A"1-1 is for activating the gate line GL1-1 of the display line DL1, the activation state A"1-2 is for activating the gate line GL5-1 of the display line DL1, and the activation state A"9-1 is for activating the gate line GL9-1 of the display line DL9.

Similar to the previous embodiments, a first time period P1" when the first gate driving signal is in the activation state (A"1-1) for activating the first gate line of the first display line does not overlap with a second time period P2" when the second gate driving signal is in the activation state (A"1-2) for activating the second gate line of the first display line.

In this embodiment, a time interval is configured between a falling edge of the second time period P2" when the second gate driving signal DS5-1 is in the activation state A"1-2 for activating the second gate line GL5-1 of the display line DL1 and a rising edge of a third time period P3" when the first gate driving signal DS1-1 is in the activation state A"9-1 for activating the first gate line GL9-1 of the display line DL9. That is, the third time period P3" when the first gate driving signal DS1-1 is in the activation state A"9-1 for activating the first gate line GL9-1 of the display line DL9 does not overlap with the second time period P2" when the second gate driving signal DS5-1 is in the activation state A"1-2 for activating the second gate line GL5-1 of the display line DL1.

Figure 10:
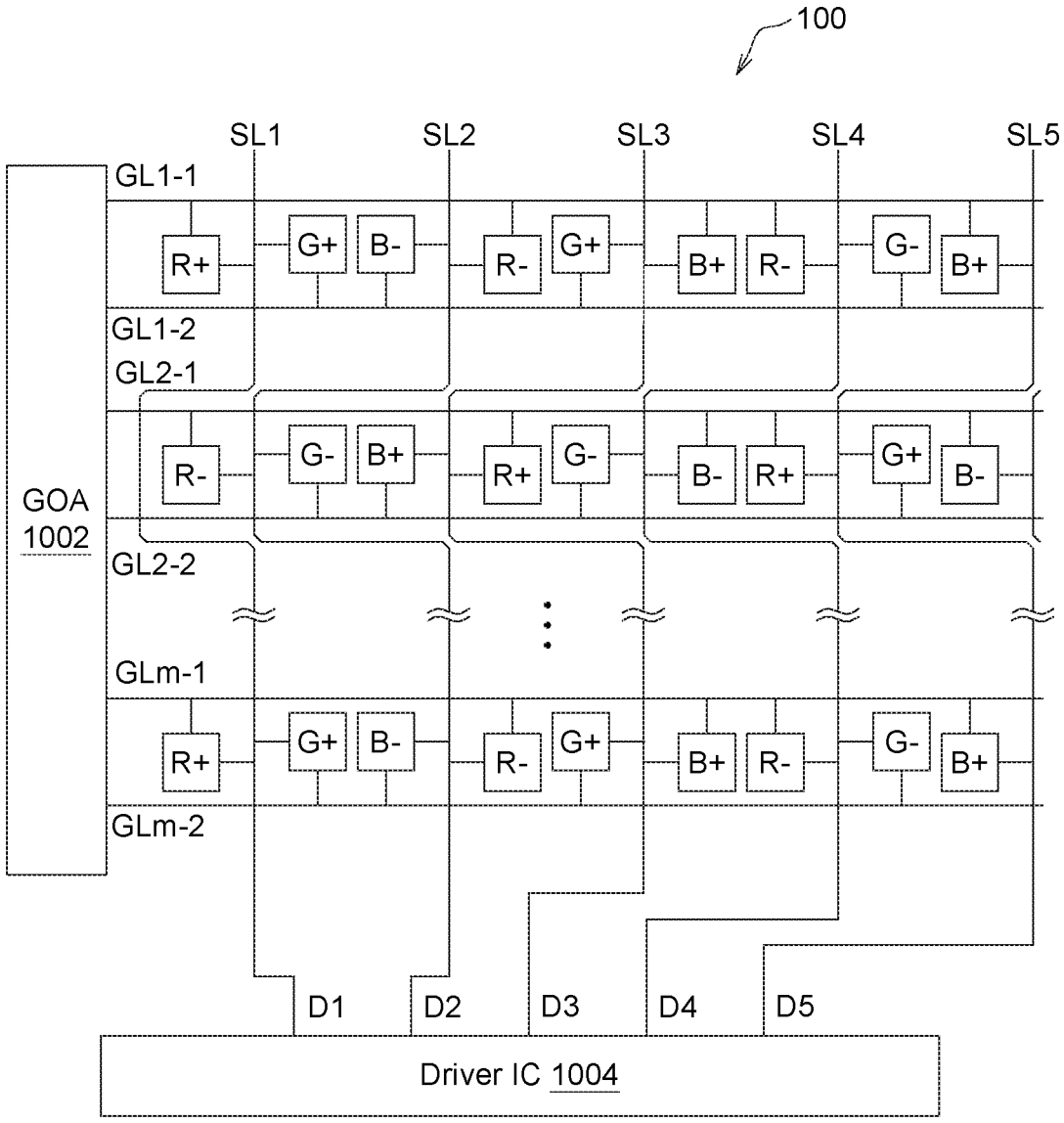
FIG. 10 shows a block diagram of a display device according to yet yet another embodiment of the present invention.
Figure 11:
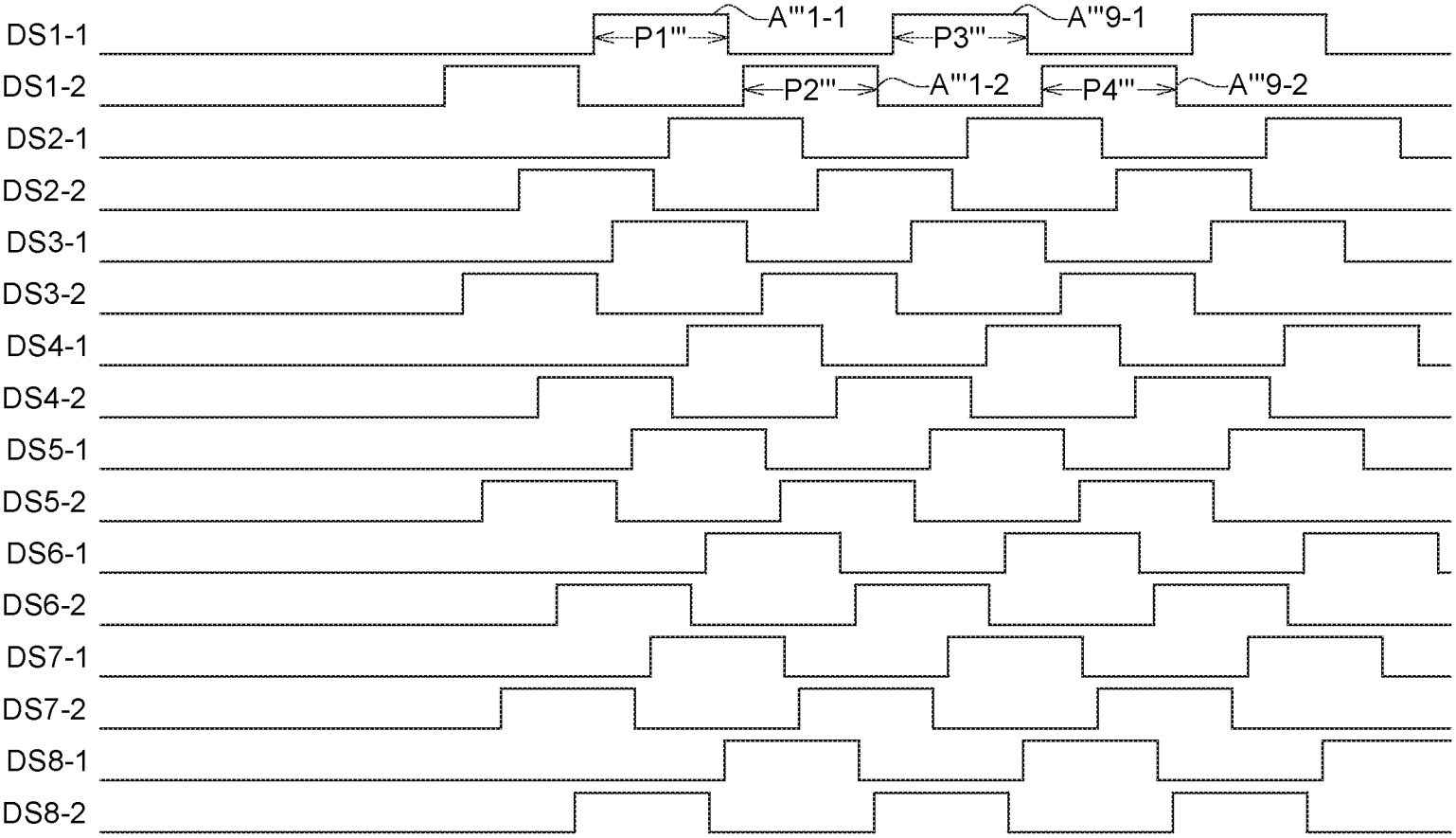
FIG. 11 shows a timing diagram of gate driving signals according to yet another embodiment of the present invention.

Referring to FIG. 10, FIG. 10 shows a block diagram of a display device according to another embodiment of the present invention. FIG. 11 shows a signal timing diagram of gate driving signals generated by the GOA circuit 1002. The gate driving signals DS1-1, DS1-2, . . . , DS8-1, DS8-2 are respectively generated for at least the gate lines GL1-1, GL1-2, . . . , GL8-1, GL8-2.

Similar to the previous embodiments, a first time period P1'" when the first gate driving signal is in the activation state A'"1-1 for activating the first gate line GL1-1 of the first display line does not overlap with a second time period P2'" when the second gate driving signal is in the activation state A'"1-2 for activating the second gate line GL1-2 of the first display line.

In this embodiment, a first time interval is configured between a falling edge of the first time period P1'" when the first gate driving signal DS1-1 is in the activation state A'"1-1 for activating the first gate line GL1-1 of the display line DL1 and a rising edge of the second time period P2'" when the second gate driving signal DS1-2 is in the activation state A'"1-2 for activating the second gate line GL1-2 of the display line DL1. A second time interval is configured between a falling edge of the second time period when the second gate driving signal DS1-2 is in the activation state A'"1-2 for activating the second gate line GL1-2 of the display line DL1 and a rising edge of a third time period P3'" when the first gate driving signal DS1-1 is in the activation state A'"9-1 for activating the first gate line GL9-1 of the display line DL9. A fourth time period P4'" when the second gate driving signal DS1-2 is in the activation state A'"9-2 is used for activating the second gate line GL9-2 of the display line DL9. In some embodiments, the first time interval equals to the second time interval.

That is, the embodiments disclosed by the present invention may be applied to a display device using dual-gate architecture. With the embodiments of the present invention, for the same display line, the timing of the two gate driving signals for driving the two gate lines are configured tor reduce or improve the coupling effect between the two gate lines. For example, two gate lines of the same display line can be driven during non-overlapped time periods, the problem of non-uniform luminance on the dual-gate display device due to the parasitic capacitances coupled between sub-pixels and the gate lines neighboring to the sub-pixels may be solved. The invention does not limited to the specific panel structures and the specific timing configurations shown in the above embodiments. Any panel type and/or the timing configuration of the gate drive signals which can reduce or improve the coupling effect between the two gate lines and make the voltage of the pixel data is more accurate can be used and is included within the scope of the present invention.

While the invention has been described by way of example and in terms of the preferred embodiment (s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A gate on array (GOA) circuit for a display device using dual-gate architecture, comprising:

driving circuitry, configured to, for a first display line of the display device, generate a first gate driving signal and a second gate driving signal for driving a first gate line and a second gate line of the first display line respectively, wherein the first gate driving signal has a plurality of time periods when the first gate driving signal is in an activation state and the second gate driving signal has a plurality of time periods when the second gate driving signal is in the activation state, a first time period when the first gate driving signal is in the activation state for activating the first gate line of the first display line does not overlap with a second time period when the second gate driving signal is in the activation state for activating the second gate line of the first display line, and at least one of the time periods when the second gate driving signal is in the activation state overlaps with at least one of the time periods when the first gate driving signal is in the activation state.

2. The GOA circuit according to claim 1, wherein none of the time periods when the second gate driving signal is in the activation state overlaps with any of the time periods when the first gate driving signal is in the activation state.

3. The GOA circuit according to claim 1, wherein the first gate line activated by the first gate driving signal during the at least one first time period and the second gate line activated by the second gate driving signal during the at least one second time period belong to different display lines of the display device.

4. The GOA circuit according to claim 1, wherein a timing of the first gate driving signal and a timing of the second gate driving signal are set to reduce coupling effect between the first gate line and the second gate line of the display line.

5. A gate on array (GOA) circuit for a display device using dual-gate architecture, comprising:

driving circuitry, configured to, for a first display line of the display device, generate a first gate driving signal and a second gate driving signal for driving a first gate line and a second gate line of the first display line respectively, and for a second display line of the display device, generate the first gate driving signal and the second gate driving signal for driving a first gate line and a second gate line of the second display line respectively, wherein a first time period when the first gate driving signal is in the activation state for activating the first gate line of the first display line does not overlap with a second time period when the second gate driving signal is in the activation state for activating the second gate line of the first display line, and a third time period when the first gate driving signal is in the activation state for activating the first gate line of the second display line does not overlap with a fourth time period when the second gate driving signal is in the activation state for activating the second gate line of the second display line, and the third time period is different from the first time period, the fourth time period is different from the second time period.

6. The GOA circuit according to claim 5, wherein the third time period when the first gate driving signal is in the activation state for activating the first gate line of the second display line does not overlap with the second time period when the second gate driving signal is in the activation state for activating the second gate line of the first display line.

7. The GOA circuit according to claim 5, wherein the third time period when the first gate driving signal is in the activation state for activating the first gate line of the second display line at least partially overlaps with the second time period when the second gate driving signal is in the activation state for activating the second gate line of the first display line.

8. A display device using dual-gate architecture, comprising:

a plurality of display lines, each of the display lines comprising a plurality of sub-pixels, a first gate line and a second gate line; and a gate on array (GOA) circuit, coupled to the display lines, and configured to, for a first display line of the display lines, generate a first gate driving signal and a second gate driving signal for driving a first gate line and a second gate line of the first display line respectively, wherein the first gate driving signal has a plurality of time periods when the first gate driving signal is in an activation state and the second gate driving signal has a plurality of time periods when the second gate driving signal is in the activation state, a first time period when the first gate driving signal is in the activation state for activating the first gate line of the first display line does not overlap with a second time period when the second gate driving signal is in the activation state for activating the second gate line of the first display line, and at least one of the time periods when the second gate driving signal is in the activation state overlaps with at least one of the time periods when the first gate driving signal is in the activation state.

9. The display device according to claim 8, wherein none of the time periods when the second gate driving signal is in the activation state overlaps with any of the time periods when the first gate driving signal is in the activation state.

10. The display device according to claim 8, wherein the first gate line activated by the first gate driving signal during the at least one first time period and the second gate line activated by the second gate driving signal during the at least one second time period belong to different display lines of the display device.

11. The display device according to claim 8, wherein a timing of the first gate driving signal and a timing of the second gate driving signal are set to reduce coupling effect between the first gate line and the second gate line of the display line.

12. A display device using dual-gate architecture, comprising:

a plurality of display lines, each of the display lines comprising a plurality of sub-pixels, a first gate line and a second gate line; and a gate on array (GOA) circuit, coupled to the display lines, and configured to, for a first display line of the display lines, generate a first gate driving signal and a second gate driving signal for driving a first gate line and a second gate line of the first display line respectively, and for a second display line of the display lines, generate the first gate driving signal and the second gate driving signal for driving a first gate line and a second gate line of the second display line respectively, wherein a first time period when the first gate driving signal is in the activation state for activating the first gate line of the first display line does not overlap with a second time period when the second gate driving signal is in the activation state for activating the second gate line of the first display line, and a third time period when the first gate driving signal is in the activation state for activating the first gate line of the second display line does not overlap with a fourth time period when the second gate driving signal is in the activation state for activating the second gate line of the second display line, and the third time period is different from the first time period, the fourth time period is different from the second time period.

13. The display device according to claim 12, wherein the third time period when the first gate driving signal is in the activation state for activating the first gate line of the second display line does not overlap with the second time period when the second gate driving signal is in the activation state for activating the second gate line of the first display line.

14. The display device according to claim 12, wherein the third time period when the first gate driving signal is in the activation state for activating the first gate line of the second display line at least partially overlaps with the second time period when the second gate driving signal is in the activation state for activating the second gate line of the first display line.

15. A gate driving control circuit for a display device using dual-gate architecture, the display device comprising a GOA circuit and a display panel comprising a plurality of display lines, each of the display lines comprising a plurality of sub-pixels, a first gate line and a second gate line, the gate driving control circuit comprising:

circuitry, configured to, generating a plurality of control signals for controlling the GOA circuit to generate a plurality of gate driving signals for scanning the first gate lines and the second gate lines of the display panel, wherein the GOA circuit is controlled to, for a first display line of the display device, generate a first gate driving signal and a second gate driving signal for driving a first gate line and a second gate line of the first display line respectively, wherein a timing of the first gate driving signal and a timing of the second gate driving signal are set to reduce coupling effect between the first gate line and the second gate line of the display line, the first gate driving signal has a plurality of time periods when the first gate driving signal is in an activation state and the second gate driving signal has a plurality of time periods when the second gate driving signal is in the activation state, a first time period when the first gate driving signal is in the activation state for activating the first gate line of the first display line does not overlap with a second time period when the second gate driving signal is in the activation state for activating the second gate line of the first display line, and at least one of the time periods when the second gate driving signal is in the activation state overlaps with at least one of the time periods when the first gate driving signal is in the activation state.

16. The gate driving control circuit according to claim 15, wherein none of the time periods when the second gate driving signal is in the activation state overlaps with any of the time periods when the first gate driving signal is in the activation state.

17. The gate driving control circuit according to claim 15, wherein the first gate line activated by the first gate driving signal during the at least one first time period and the second gate line activated by the second gate driving signal during the at least one second time period belong to different display lines of the display device.

18. A gate driving control circuit for a display device using dual-gate architecture, the display device comprising a GOA circuit and a display panel comprising a plurality of display lines, each of the display lines comprising a plurality of sub-pixels, a first gate line and a second gate line, the gate driving control circuit comprising:

circuitry, configured to, generating a plurality of control signals for controlling the GOA circuit to generate a plurality of gate driving signals for scanning the first gate lines and the second gate lines of the display panel, wherein the GOA circuit is controlled to, for a first display line of the display device, generate a first gate driving signal and a second gate driving signal for driving a first gate line and a second gate line of the first display line respectively, and for a second display line of the display device, generate the first gate driving signal and the second gate driving signal for driving a first gate line and a second gate line of the second display line respectively, wherein a timing of the first gate driving signal and a timing of the second gate driving signal are set to reduce coupling effect between the first gate line and the second gate line of the display line, a first time period when the first gate driving signal is in the activation state for activating the first gate line of the first display line does not overlap with a second time period when the second gate driving signal is in the activation state for activating the second gate line of the first display line, and a third time period when the first gate driving signal is in the activation state for activating the first gate line of the second display line does not overlap with a fourth time period when the second gate driving signal is in the activation state for activating the second gate line of the second display line, and the third time period is different from the first time period, the fourth time period is different from the second time period.

19. The gate driving control circuit according to claim 18, wherein the third time period when the first gate driving signal is in the activation state for activating the first gate line of the second display line does not overlap with the second time period when the second gate driving signal is in the activation state for activating the second gate line of the first display line.

20. The gate driving control circuit according to claim 18, wherein the third time period when the first gate driving signal is in the activation state for activating the first gate line of the second display line at least partially overlaps with the second time period when the second gate driving signal is in the activation state for activating the second gate line of the first display line.

* * * * *